US008671466B2

(12) United States Patent
Perbet et al.

(10) Patent No.: US 8,671,466 B2
(45) Date of Patent: Mar. 18, 2014

(54) HELMET SHELL MADE OF COMPOSITE MATERIAL

(75) Inventors: Jean-Noël Perbet, Eysines (FR); Christophe Coupeaud, St Medard en Jalles (FR); Laurent Laluque, Bordeaux (FR); Joël Baudou, St Medard en Jalles (FR); Philippe Viot, Gradignan (FR); Sébastien Denneulin, Merignac (FR); Virginie Rejsek, Bordeaux (FR); Matthieu Gervais, Paris (FR); Alain Soum, Gradignan (FR)

(73) Assignee: Thales, Neuilly-sur-Seine (FR)

( * ) Notice: Subject to any disclaimer, the term of this patent is extended or adjusted under 35 U.S.C. 154(b) by 391 days.

(21) Appl. No.: 12/917,955

(22) Filed: Nov. 2, 2010

(65) Prior Publication Data

US 2011/0265235 A1 Nov. 3, 2011

(30) Foreign Application Priority Data

Nov. 3, 2009 (FR) ..... 09 05261

(51) Int. Cl.
*A42B 1/06* (2006.01)
*A42B 3/00* (2006.01)
*F41H 1/04* (2006.01)

(52) U.S. Cl.
USPC ..... 2/410; 2/6.1

(58) Field of Classification Search
USPC ..... 2/2.5, 410, 6.1, 6.6, 411, 425, 412; 428/113; 442/135
See application file for complete search history.

(56) References Cited

U.S. PATENT DOCUMENTS

| | | | | |
|---|---|---|---|---|
| 2,351,235 | A * | 6/1944 | Shroyer et al. | 2/5 |
| 3,567,568 | A * | 3/1971 | Windecker | 442/224 |
| 3,956,447 | A | 5/1976 | Denommee et al. | |
| 3,958,276 | A * | 5/1976 | Clausen | 2/2.5 |
| 4,023,209 | A * | 5/1977 | Frieder et al. | 2/6.6 |
| 4,748,064 | A * | 5/1988 | Harpell et al. | 428/113 |
| 5,057,904 | A * | 10/1991 | Nagato et al. | 257/693 |
| 5,361,420 | A * | 11/1994 | Dobbs et al. | 2/425 |
| 5,749,096 | A * | 5/1998 | Fergason et al. | 2/8.3 |
| 7,328,462 | B1 * | 2/2008 | Straus | 2/411 |
| 2003/0199215 | A1 * | 10/2003 | Bhatnagar et al. | 442/135 |
| 2003/0200861 | A1 * | 10/2003 | Cordova et al. | 89/36.02 |
| 2010/0287687 | A1 * | 11/2010 | Ho | 2/411 |
| 2011/0047680 | A1 * | 3/2011 | Hoying et al. | 2/414 |
| 2011/0203024 | A1 * | 8/2011 | Morgan | 2/2.5 |

FOREIGN PATENT DOCUMENTS

| | | | |
|---|---|---|---|
| EP | 1 300 089 | A1 | 4/2003 |
| WO | 2008/101138 | A1 | 8/2008 |

OTHER PUBLICATIONS

B. McEntire, "Helmet-Mounted Displays: Design Issues for Rotary-Wing Aircraft, Chapter 7: Biodynamics," SPIE (C. Rash, Ed.), Jan. 25, 2001, pp. 167-196.

* cited by examiner

*Primary Examiner* — Amber Anderson
(74) *Attorney, Agent, or Firm* — Baker & Hostetler LLP

(57) ABSTRACT

The general field of the invention is that of helmet shells made of composite material comprising at least one "armure" of fabrics impregnated with a resin matrix. Certain parts of the "armure" are impregnated with a resin matrix comprising an additive adapted to reinforce the mechanical strength of the helmet, the said parts corresponding to the weakest zones of a human head, such as the top of the head or the ears. Preferably, the resin is of the epoxy type and the additive is based on acrylic block copolymers. More precisely, the additive is of the "Nanostrength®" brand.

5 Claims, 3 Drawing Sheets

HELMET SHELL MADE OF COMPOSITE MATERIAL

CROSS-REFERENCE TO RELATED APPLICATION

This application claims priority to foreign French patent application No. FR 0905261, filed on Nov. 3, 2009, the disclosure of which is incorporated by reference in its entirety.

FIELD OF THE INVENTION

The field of the invention is that of composite structural materials for the purpose of withstanding impacts and protecting against penetration. The main field of application is that of protective helmets for aircraft pilots. The structures according to the invention may, however, be used for any fields requiring very strong and lightweight protective structures.

BACKGROUND

In the field of helmets for warplane or helicopter pilots, it is desirable to produce shells which have the lowest possible mass in order to minimize the forces on the pilot's cervical vertebrae during accelerations of the aircraft. However, the helmet needs to provide sufficient protection, as described for example in military standards such as the standard entitled "Military Aircrew Helmet Impact Standard" published by "UK Ministry of Defence".

The technological solutions employed for producing helmet shells must remain simple in industrial terms. The conventional solutions for solving this problem are:

- the use of thermoplastic materials on their own, injected according to the desired shape;
- superimposing a composite shell and a foam absorbing the energy of impacts;
- the use of conventional composite materials. The latter are composed of at least two different materials: a matrix which is a resin and a fabric woven according to an "armure" expediently selected according to the intended application. FIG. 1 represents an example of a composite material comprising three layers of fabrics T before coating with the resin R. The manufacturing method is represented in FIG. 2. It comprises three main steps, namely preparation of the resin base, impregnation of the armure with the base, and polymerization of the impregnated structure. It is known that this type of material has much better mechanical properties than the base elements taken independently. The matrix may be a thermoplastic or thermoset. The most conventional case of a composite is the carbon-epoxy composite;

The solutions offer satisfactory resistances to impacts and penetration with thicknesses of a few millimeters. If there is a desire to lighten these materials, however, the conventional technical means have already been explored. Mention may be made of reducing the proportion of resin, expedient choice of the armure of the fibres and the orientation of the successive plies of the fabric, optimizing the final baking of the monolith or using foams with variable thicknesses.

SUMMARY OF THE INVENTION

The structure according to the invention makes it possible either to improve the resistance to impact and penetration for a given thickness of composite, or to reduce the thickness of composite for a given resistance to impact and penetration.

The technical solution consists in adding particular polymers in the region of the composite in order to increase the resistance to impact and penetration, with an equivalent mass. This addition is industrially very simple, since particles are dispersed in the base of a resin, then the resin is prepared and the composite is shaped and coated according to the same method as conventional preparation. In order to simplify production of the composite, the use of this solution is limited to the most sensitive zones of the head. Specifically, it has been shown that the regions of the top of the head and the ears withstand less energy than the rest of the skull before injury. Reference may be made to the report by J. McEntire, in Helmet Mounted Displays: Design Issues for Rotary-Wing Aircrafts, edited by C. E. Rash for all details on this subject.

More precisely, the invention firstly relates to a helmet shell made of a composite material comprising at least one "armure" of fabrics impregnated with a resin matrix, characterized in that certain dedicated parts of the "armure" are impregnated with a resin matrix comprising an additive adapted to reinforce the mechanical strength of the helmet, the said parts corresponding to the weakest zones of a human head, the remainder of the "armure" being impregnated with a resin matrix not comprising the said additive.

Advantageously, the resin is a resin of the epoxy type and the additive is based on acrylic block copolymers, and, more precisely, the acrylic block copolymers are of the "Nanostrength®" brand marketed by Arkéma.

Advantageously, the parts of the "armure" comprising the additive are the upper part of the shell, corresponding to the top of the skull, and the left and right lateral parts corresponding to the ears.

The invention secondly relates to a pilot helmet comprising at least one helmet shell according to one of the characteristics above.

Lastly, it thirdly relates to a method for producing a helmet shell made of composite material comprising at least one "armure" of fabrics impregnated with a resin matrix, the said method comprising the following steps:

- preparation of a first base consisting only of the epoxy resin;
- preparation of a second base consisting of the epoxy resin and an additive adapted to reinforce the mechanical strength;
- impregnation of the fabrics by means of the second base in the parts corresponding to the weakest zones of the human head;
- impregnation of the fabrics by means of the first base outside the said parts;
- polymerization of the impregnated fabrics.

BRIEF DESCRIPTION OF THE DRAWINGS

The invention will be understood more clearly, and other advantages will become apparent, on reading the following description which is given nonlimitingly and with the aid of the appended figures, in which.

DETAILED DESCRIPTION

Figure 1:
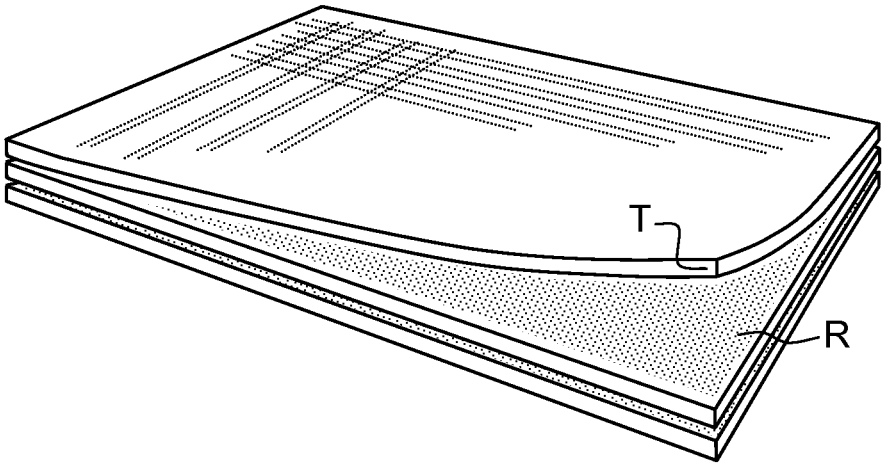
FIG. 1 represents a composite material before impregnation.
Figure 2:
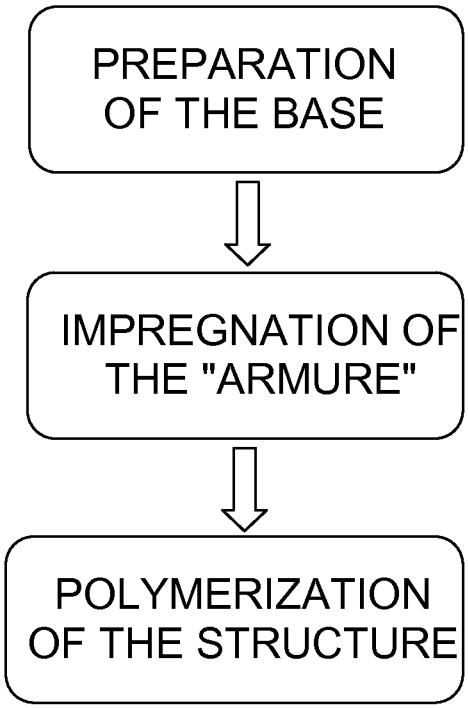
FIG. 2 represents the main manufacturing steps of a composite material according to the prior art.
Figure 3:
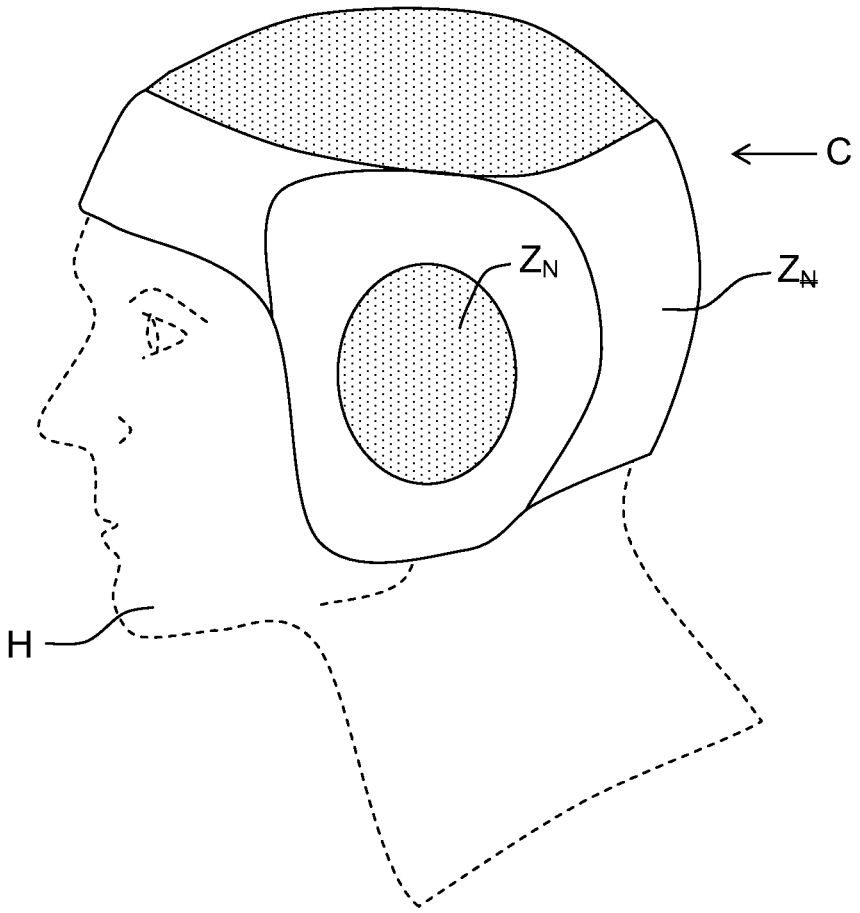
FIG. 3 represents a helmet shell according to the invention.

As already mentioned, a helmet shell made of composite material according to the invention comprises at least one "armure" of fabrics, certain parts of which are impregnated with a resin matrix comprising an additive adapted to reinforce the mechanical strength of the helmet, the said parts corresponding to the weakest zones of a human head. A conventional resin is kept for the other zones of the shell. Such a shell is represented in FIG. 3. The parts $Z_N$ of the shell C comprising the additive have a dotted pattern, while the parts $Z_N$ not comprising the additive are blank in this figure. The head H is represented by dashes. These parts of the "armure", comprising the additive, are essentially the upper part of the shell corresponding to the top of the skull and the left and right lateral parts corresponding to the ears.

A resin of the epoxy type is more particularly used, and the additive is based on acrylic block copolymers.

The added polymers have a so-called "triblock" structure which, once formulated with an epoxy resin, makes it possible to obtain structuring of the matrix on the nanometric scale. This structuring makes it possible to modify the mechanical properties of the composite significantly.

More precisely, the acrylic block copolymers are of the "Nanostrength®" brand marketed by Arkéma. The Nanostrength® compounds are divided into two families, namely:

"SBM": abbreviation for polyStyrene-block-poly(1,4-Butadiene)-block-poly(Methyl methacrylate);

"MAM": poly(Methyl methAcrylate)-block-poly(butyl acrylate)-block-poly(Methyl methacrylate).

In order to simplify production of the shell, it is of course possible to use a single resin comprising the additive in order to produce all of the shell. The production of such a shell, however, presents certain drawbacks. This is because adding polymers of the "Nanostrength®" type in epoxy resins increases the viscosity of the substance. This leads to operation being more difficult and a higher proportion of resin in the composite, which makes it heavier and more brittle.

As an exemplary embodiment, an "armure" consisting of three plies of poly-para-phenyleneterephthalamide, better known by the brand "Kevlar", may be used as the composite. More precisely, it is feasible to choose "Kevlar" 129 of the brand Saatilarâ style 802, taffeta woven, with a density of 190 g/m$^2$ and a thickness of 260 μm, coated with a resin of the reference "Epolam 2020" marketed by Axson and representing 40% of the mass of the composite. The reinforced parts consist of the same number of plies of the same reinforcing fabric but with an epoxy resin filled with "Nanostrength M22N". The percentage of "Nanostrength M22N" may be between 5% and 15%. Tests of resistance to mechanical impacts on sample plates show that the deformation of the parts reinforced with "Nanostrength®" is about ten times less than that of the non-reinforced parts.

Figure 4:
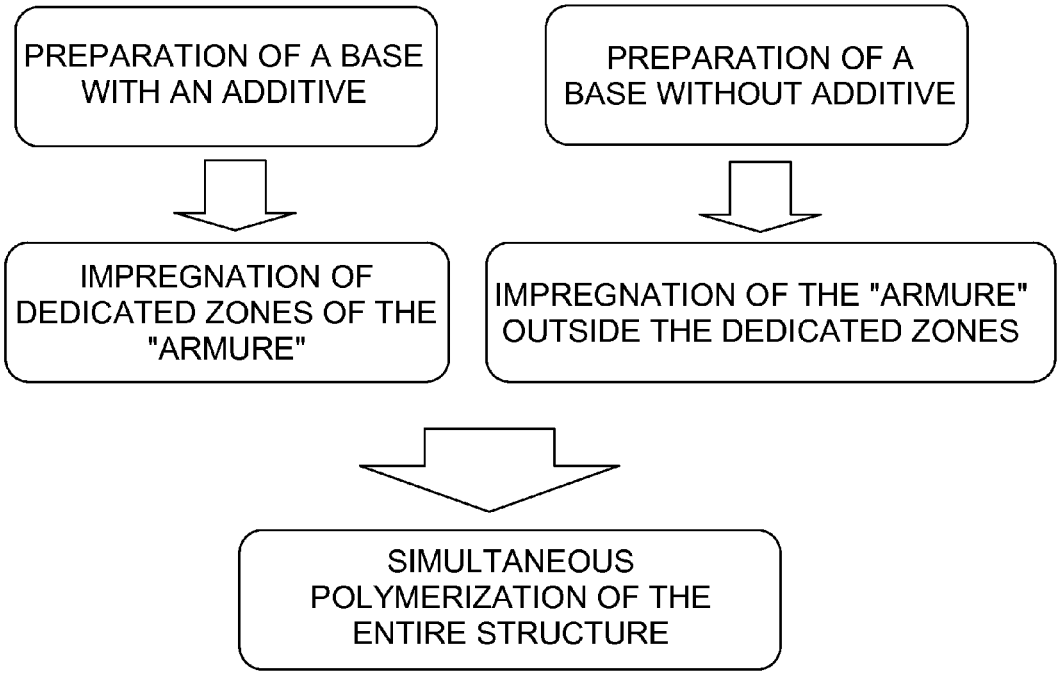
FIG. 4 represents the main manufacturing steps of a composite material according to the invention.

The method for producing the shell is represented schematically in FIG. 4, and comprises the following steps:

preparing a first base comprising only the epoxy resin;

preparing a second base comprising the epoxy resin and an additive adapted to reinforce the mechanical strength;

impregnating the fabrics by means of the second base in the parts corresponding to the weakest zones of a human head;

impregnating the fabrics by means of the first base outside the said parts;

polymerizing the impregnated fabrics.

More precisely, the way of preparing the second base with a dispersion of "Nanostrength®" polymers is as follows:

heating the epoxy base to a temperature of between 80° C. and 130° C.;

adding 10% by mass of "Nanostrength®" to the epoxy base;

mixing with a mechanical stirrer for a time of between 1 hour and 4 hours with a speed of 300 revolutions per minute;

cooling the formulation to room temperature;

adding the curer and mixing by hand until a homogeneous preparation is obtained.

The way of preparing the composite without "Nanostrength®" polymer is the same, except that no additive is added to the epoxy base. The pressing parameters, such as the pressure all the time, and the polymerization parameters such as the temperature, the pressure or the time, are the same for the unfilled resin as those mentioned above.

Impregnations with and without "Nanostrength®" may then be carried out sequentially, followed by simultaneous pressing and polymerization of all the regions of the shell. The impregnation and polymerization of the fabrics comprise the following steps:

impregnating the plies of the reinforcement with a brush;

removing the excess resin in a press at 1.5 bar at room temperature for a duration of 5 minutes;

polymerizing everything in a heating press at 1.5 bar at 90° C. for a duration of 90 minutes;

allowing it to cool to room temperature;

final baking for 2 hours at a temperature of 80° C.

During the impregnation step, the epoxy resin with or without "Nanostrength®" is applied with a brush in order to impregnate the reinforcement plies. A template may be used in order to delimit the application zones. A first template masks the top of the head and the ears, and makes it possible to apply the unfilled resin. A second template masks the front, rear and sides of the shell, and makes it possible to apply the resin filled with "Nanostrength®".

What is claimed is:

1. A helmet shell made of a composite material comprising a single armor layer comprised of multiple plies of fabrics impregnated with a resin matrix, each ply of fabric covering all of said armor layer, the helmet shell having a crown, front, back, left and right portions shaped to cover a respective crown, front, back, left and right portions of a wearer's head and ears, wherein certain dedicated parts ($Z_N$) of the armor layer are impregnated with a resin matrix comprising an additive adapted to reinforce a mechanical strength of the helmet, wherein the dedicated parts are located at the crown, left, and right portions of the helmet shell corresponding to the weakest zones of the wearer's head, and wherein a remainder of the portion of the helmet shell having the armor layer is impregnated with a resin matrix not comprising the additive.

2. The helmet shell according to claim 1, wherein the resin is a resin of an epoxy type and the additive comprises acrylic block copolymers.

3. The helmet shell according to claim 2, wherein the acrylic block copolymers are polyStyrene-block-poly(1,4-Butadiene)-block-poly(Methyl methacrylate) or poly(Methyl methacrylate)-block-poly(butyl acrylate)-block-poly (Methyl methacrylate).

4. A pilot helmet comprising at least one helmet shell according to claim 1.

5. A method for producing a helmet shell made of composite material comprising a single armor layer comprised of multiple plies of fabrics impregnated with a resin matrix, each ply of fabric covering all of said armor layer, the helmet shell having a crown, front, back, left and right portions shaped to cover a respective crown, front, back, left and right portions of a wearer's head and ears, the method comprising the following steps:

preparation of a first base consisting only of an epoxy resin;

preparation of a second base consisting of the epoxy resin and an additive adapted to reinforce a mechanical strength of the helmet shell;

impregnation of the fabrics by means of the second base in parts of the helmet shell located at the crown, left, and right portions corresponding to the weakest zones of a human head;

impregnation of the fabrics by means of the first base outside the said parts;

polymerization of the impregnated fabrics.

* * * * *